US009527100B2

(12) United States Patent
Buck et al.

(10) Patent No.: US 9,527,100 B2
(45) Date of Patent: Dec. 27, 2016

(54) INJECTOR NOZZLE

(71) Applicants: Oliver Buck, Metzingen (DE); Thomas Schenk, Neuffen (DE); Joaquim Gomes-Alves, Reutlingen (DE)

(72) Inventors: Oliver Buck, Metzingen (DE); Thomas Schenk, Neuffen (DE); Joaquim Gomes-Alves, Reutlingen (DE)

(73) Assignee: LECHLER GMBH, Metzingen (DE)

( * ) Notice: Subject to any disclaimer, the term of this patent is extended or adjusted under 35 U.S.C. 154(b) by 0 days.

(21) Appl. No.: 14/661,733

(22) Filed: Mar. 18, 2015

(65) Prior Publication Data

US 2015/0266045 A1 Sep. 24, 2015

(30) Foreign Application Priority Data

Mar. 24, 2014 (DE) ..... 10 2014 205 399

(51) Int. Cl.

| | |
|---|---|
| ***B05B 7/04*** | (2006.01) |
| ***B05B 15/06*** | (2006.01) |
| *B05B 1/04* | (2006.01) |
| *B05B 1/14* | (2006.01) |

(52) U.S. Cl.

CPC ..... *B05B 15/069* (2013.01); *B05B 7/0425* (2013.01); *B05B 1/046* (2013.01); *B05B 1/14* (2013.01)

(58) Field of Classification Search

CPC ..... B05B 7/0425; B05B 1/046; B05B 1/14; B05B 15/065; B05B 15/069

USPC ..... 239/398, 589, 428.5, 600

See application file for complete search history.

(56) References Cited

U.S. PATENT DOCUMENTS

| | | | | |
|---|---|---|---|---|
| 2,388,508 | A | 11/1945 | Timpson | |
| 5,253,807 | A * | 10/1993 | Newbegin | A01G 25/023 239/11 |
| 5,615,836 | A | 4/1997 | Graef | |
| 6,398,128 | B1 * | 6/2002 | Hamilton | B05B 1/042 239/600 |
| 7,357,337 | B2 * | 4/2008 | Ferrari | E03C 1/08 239/428.5 |
| 2009/0321543 | A1 | 12/2009 | Lawyer et al. | |
| 2011/0198420 | A1 | 8/2011 | Lawyer et al. | |

(Continued)

FOREIGN PATENT DOCUMENTS

| | | | |
|---|---|---|---|
| DE | 43 38 585 | A1 | 5/1995 |
| WO | WO 2006/002300 | A1 | 1/2006 |
| WO | WO 2013/064989 | A1 | 5/2013 |

OTHER PUBLICATIONS

Search Report of European Patent Office issued in Application No. 15 158 170.9 with English translation of categories of cited documents dated Sep. 2, 2015 (5 pages).

(Continued)

*Primary Examiner* — Jason Boeckmann

(74) *Attorney, Agent, or Firm* — Flynn, Thiel, Boutell & Tanis, P.C.

(57) ABSTRACT

An injector nozzle having a housing, an interior space of the housing being defined in sections by a housing wall, and having an injector component arranged in the interior space of the housing at least in sections, wherein the housing wall has at least one through hole, the at least one through hole being appropriate for a human finger to reach in, at least in sections, and wherein the injector component has at least one handle portion, which handle portion is accessible via the through hole.

20 Claims, 3 Drawing Sheets

(56) References Cited

U.S. PATENT DOCUMENTS

2013/0043321 A1 2/2013 Thomas et al.

OTHER PUBLICATIONS

Office Action of German Patent Office issued in Application No. 10 2014 205 399.4 dated Dec. 10, 2014 (5 pages).

* cited by examiner

INJECTOR NOZZLE

CROSS-REFERENCE TO RELATED APPLICATIONS

This application claims the priority of German Application No. 10 2014 205 399.4, filed on Mar. 24, 2014, the disclosure of which is hereby incorporated by reference in its entirety into this application.

FIELD OF THE INVENTION

The invention relates to an injector nozzle having a housing and having an injector component arranged in the interior space of the housing at least in sections.

BACKGROUND AND SUMMARY OF THE INVENTION

An aim of the invention is to provide an improved injector nozzle.

According to the invention, an injector nozzle having a housing and having an injector component arranged in the interior space of the housing at least in sections is provided, wherein the injector component has at least one handle portion which is accessible from the outer side of the housing.

Owing to the fact that the injector component or a handle portion of the injector component is accessible from the outer side of the housing, the injector component can be removed from the housing of the injector nozzle in a simple manner without using a tool. An essential feature thereby is that the handle portion of the injector component is accessible from an outer side of the housing in such a way that, even with the housing taken off from a nozzle support, the injector component does not have to be grasped from the inflow side, but may be grasped simply from the outer side of the housing at the handle portion, and may be pushed out of the housing counter to the flow direction, for example.

In an advanced embodiment of the invention, the housing has at least one through hole, wherein the at least one through hole is appropriate for a human finger to reach in, at least in sections, and wherein the handle portion of the injector component is accessible via the through hole.

By providing a through hole and a handle portion on the injector component, the injector component can be removed from the housing of the injector nozzle in a very simple manner without using a tool. Said feature is very advantageous in particular for use in agricultural technology.

Occasionally, injector components of injector nozzles need to be replaced or disassembled for cleaning. The possibility to remove the injector component of the injector nozzle according to the invention from the housing without using a tool, facilitates such maintenance procedures considerably and allows such operations to be accomplished in a short time and without difficulty, even during field work. Attention should be paid to the fact that in agricultural technology there is, in general, a need to wear protective gloves due to the spraying of agricultural chemicals. As a result, handling of tools is awkward so that by providing the invention, a considerable improvement in the handling of an injector nozzle is achieved.

In an advanced embodiment of the invention, a housing wall has two opposite through holes.

In this manner, an operator is enabled to grasp one or two handle portions of the injector component in a pinch grip using two fingers reaching through the two opposite through holes. Thereby, even comparatively high operating forces can be applied and the injector component can reliably be removed from the housing without a tool.

In an advanced embodiment of the invention, the at least one through hole is in a rectangular or oval shape.

Upon inserting the injector component into the housing, a rectangular or oval through hole provides a certain sliding path. In this case, a longer side or dimension of the through holes is parallel to the exit direction of the injector.

In an advanced embodiment of the invention, the injector component has corrugations at least in a region that is located in the vicinity of the at least one through hole of the housing in the assembled state.

By means of corrugation, the feel of the handle portion can be improved essentially so that, even with gloved fingers, the injector component can be removed without difficulty.

In an advanced embodiment of the invention, the injector component has a mixing chamber housing which together with an inner wall of the nozzle housing constitutes an air intake compartment, and at least one operating piece disposed at a distance to the mixing chamber housing and arranged in the vicinity of the at least one through hole of the housing, in the assembled state of the injector component.

In this manner, the operating piece with the handle portion can be arranged within the housing, and there is a zone of the air intake compartment defined between the operating piece and the mixing chamber housing.

In an advanced embodiment of the invention, the housing has two opposite through holes and the injector component has two opposite operating pieces each provided with a handle portion.

Providing two opposite handle portions allows not only reliable grasping and displacing of the injector component, but also there is application of force symmetrical to the injector component during sliding out of the latter, such that there is no risk of jamming or tilting of the injector component during sliding out. In any case, due to the symmetrical application of force on the opposite operating pieces, even a tight sitting injector component may be moved out of the housing reliably and without using a tool.

In an advanced embodiment of the invention, the at least one operating piece with the handle portion extends from a flange connected to the mixing chamber housing and projects freely beyond the flange.

In this manner, the operating pieces can be disposed immediately behind the inner wall of the housing and in the vicinity of the through holes and, all the same, there remains room for a sufficiently large air intake compartment between the operating pieces and the mixing chamber housing. Advantageously, the flange is a disc-shaped ring or an annular flange.

BRIEF DESCRIPTION OF THE DRAWINGS

Further features and advantages of the invention will become apparent from the claims and the following description of a preferred embodiment of the invention in connection with the drawings. In the drawings:

DETAILED DESCRIPTION

Figure 1:
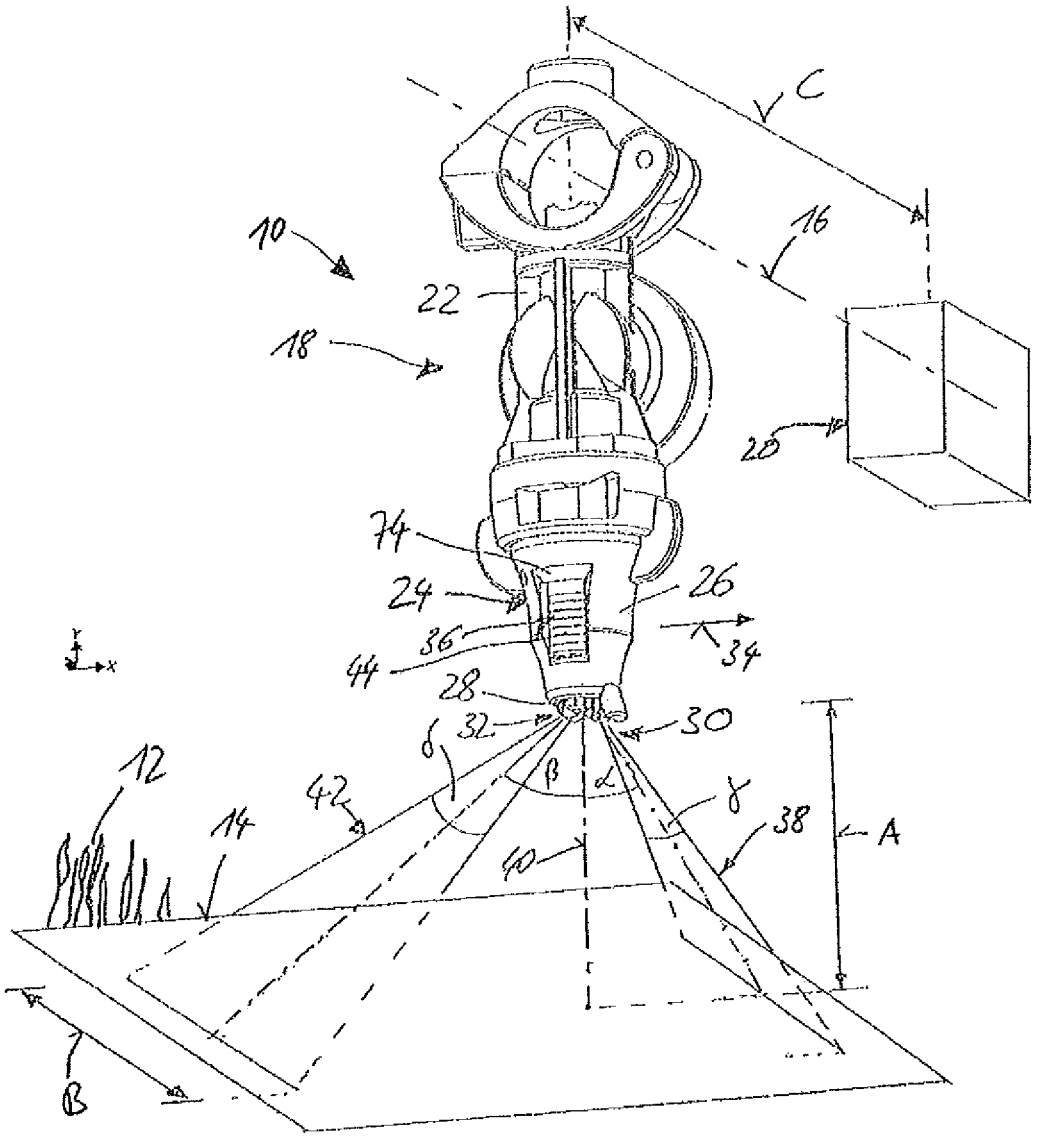
FIG. 1 shows an isometric, partially schematical illustration obliquely from below of a spray device according to the invention including an injector nozzle according to the invention.

The illustration of FIG. 1 shows a spray device 10 according to the invention which is intended for spraying crop plants 12 on a soil surface 14. The line of sight of a viewer in FIG. 1 is from obliquely below to the spray device 10 and to the soil surface 14, that is, the viewer is positioned on an imaginary point below the soil surface 14 in FIG. 1. The spray device 10 is illustrated only schematically and includes a distributor tube, illustrated in FIG. 1 by not more than its central longitudinal axis 16. On the distributor tube, multiple nozzle devices 18, 20 are disposed, wherein the second nozzle device 20 is indicated merely schematically in the form of a rectangular block. Each of the nozzle devices 18, 20 has a nozzle support 22 and a double flat spray nozzle 24 designed as an injector nozzle. The double flat spray nozzle 24 is attached on a matching connector flange of the nozzle support 22 via a bayonet coupling, which support in turn is disposed on the distributor tube and is to supply an agricultural chemical to be sprayed to the double flat spray nozzle 24. The double flat spray nozzle 24 or injector nozzle has a housing 26 with a downstream portion 26*a* which is provided with a nozzle mouthpiece 28 including a first outlet opening 30 and a second outlet opening 32. The spray device 10 is moved across the soil surface 14 along a movement direction 34. An injector component 36 is arranged in the nozzle housing 26 and in FIG. 1 merely portions thereof are visible. By means of the injector component 36, air is admixed to the agricultural chemical to be sprayed within the nozzle housing 26 so that coarse drops are ejected from the outlet openings 30, 32 and said drops are subject to not more than minor drift caused by wind.

A flat jet 38 exits from the first outlet opening 30 and has an output angle $\alpha$ with respect to a central longitudinal axis 40 of the housing 26 of the double flat spray nozzle 24. Said first flat jet 38 has a jet angle $\gamma$.

A second flat jet 42 exits from the second outlet opening 32. Said second flat jet 42 has an output angle $\beta$ with respect to the central longitudinal axis 40 of the housing 26. Said second flat jet 42 has a jet angle $\delta$.

The outlet openings 30, 32 and, thus, the bottom end of the housing 26 in FIG. 1 are disposed at a distance A from the soil surface 14. The flat jets 38, 42 are impacting on the soil surface 14 with a jet width B, wherein the jet widths B of the two flat jets 38, 42 on the soil surface 14 are identical in size with the double flat spray nozzle 24 according to the invention. With the double flat spray nozzle 24, the output angles $\alpha$, $\beta$ and the jet angles $\gamma$, $\delta$ of the two flat jets 38, 42 outputted from the outlet openings 30, 32 are matched to one another in such a manner that at a distance A and, thus, on the soil surface 14, both the flat jets 38, 42 have the same jet width B.

The two nozzle devices 18, 20 are disposed at a distance C along the central longitudinal axis 16 of the distributor tube. Said distance C is matched to the jet width B in such a manner that the flat jets of the respective double flat spray nozzles are overlapping in a marginal region.

In the illustration of FIG. 1, merely a handle portion 44 of the injector component 36 is visible, which has corrugations and is located in the vicinity of a through hole 74 of the housing 26. The handle portion 44 is arranged directly behind the through hole 74 which is illustrated in a rectangular shape, but may alternatively be oval-shaped as shown in dotted lines in FIG. 4. A longer extension of the through hole 74 is parallel to the central longitudinal axis 40 of the housing 26. The handle portion 44 can be grasped by a human finger reaching through the through hole 74 and, thereby, the injector component 36 in FIG. 1 can be pushed upwards and out of the housing 26, as will be explained in more detail below. Of course, this is feasible only when the housing 26 is taken off the nozzle support 22.

Figure 2:
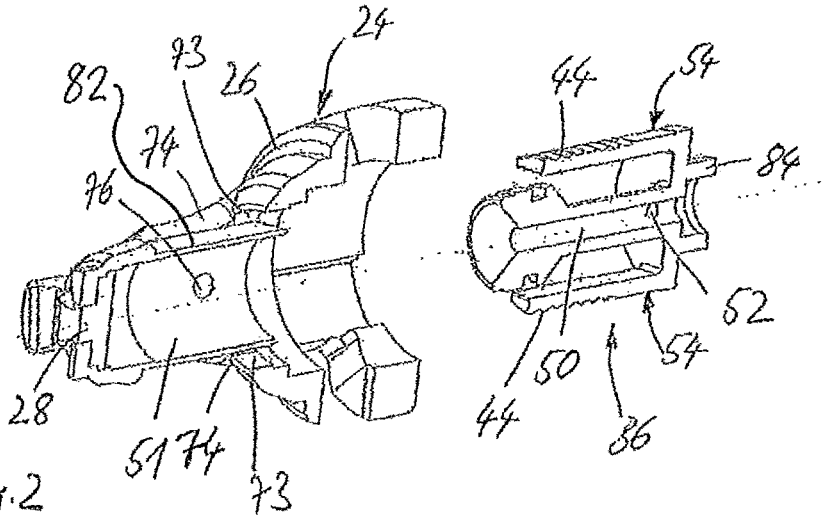
FIG. 2 shows an expanded, sectional illustration of the injector nozzle according to the invention of FIG. 1.

The illustration of FIG. 2 shows the double flat spray nozzle 24 or injector nozzle according to FIG. 1 in a sectional view and in an expanded illustration. Hence, in the illustration, the injector component 36 is located outside the housing 26, whereas the nozzle mouthpiece 28 is already inserted in the housing 26.

The injector component 36 has a mixing chamber 50 located inside a wall 50*a* of the injector component 36, which chamber 50 has an initially circular cylindrical cross section and is then conically enlarging along the outflow direction. The agricultural chemical is injected into the mixing chamber 50 in the form of a single spray jet from the end located on the right hand side in FIG. 2 via a baffle not illustrated in FIG. 2. Said spray jet produces, in the vicinity of its input, a negative pressure in the mixing chamber 50 to thereby entrain air, which air can enter into the mixing chamber 50 via a first air ventilation opening 52. A second air ventilation opening 52 is located opposite the first opening 52, but not visible in FIG. 2.

The injector component 36 is provided with two operating pieces 54 which are located one opposite to the other and accessible via the through holes 74 of the housing 26 in the vicinity of the respective handle portion 44, as is apparent from FIG. 1 in sections. By means of the operating pieces 54, the injector component can be removed from the housing without using a tool and installed back again, respectively. For that purpose, the injector component 36 is pushed into the housing from the side of the housing 26 located upstream in the outflow direction, as is apparent from FIG. 2. For pushing the injector component 36 out, the component is gripped with two fingers on the handle portions 44 and then pushed out of the housing 26, that is, counter to the outflow direction, towards the right hand side in FIG. 2.

The housing 26 has a circular cylindrical interior space 51 into which the portion of the injector component 36 constituting the mixing chamber 50 is inserted. Said interior space 51 is provided with two air ventilation openings 76 for communicating connection of the interior space to the environment. Between the mixing chamber portion or wall 50*a* of the injector component 36 and the inner wall of the interior space 51, there is an annular gap space 70 produced in the assembled state, cf. FIG. 3, the annular gap being in communication with the environment via the air ventilation openings 76, cf. FIG. 3. The housing 26 includes the two rectangular through holes 74, as viewed from the housing exterior, however, said holes 74 are not open towards the interior space 51, but merely penetrate the exterior shell of the housing 26 and allow access to an outer wall 82 of the circular cylindrical interior space 51 in the disassembled state according to FIG. 2. Located between an upstream portion 26*b* of the housing 26 and the outer wall 82 of the interior space 51 in the vicinity of the through holes 74, there is a respective slot 73 into which the operating pieces 54 of the injector component 36 are inserted from the right hand side according to FIG. 2. Thus, in the assembled state of the double flat spray nozzle according to the invention, the portion of the injector component 36 constituting the mixing chamber 50 is located within the interior space 51, whereas the operating pieces 54 are located outside the interior space 51 and the handle portions 44 with corrugations on the operating pieces 54 are accessible through the through holes 74 of the housing 26.

In order to insert the injector component 36 into the housing 26, the component is pushed into the housing 26 along the flow direction. In order to remove the injector component 36 again from the housing 26, for example, to replace it due to wear or obstruction, all that needs to be done is to grasp the handle portions 44 of the operating pieces 54 by reaching through the through holes 74 and displacing them counter to the outflow direction. In that context, the through holes 74 are dimensioned such that a human thumb or a human index finger may reach through the through holes 74 and get hold of the handle portions 44 of the operating pieces 54. Thereby, the injector component 36 can be removed from the housing 26 and installed back therein in a very simple manner, even with a gloved hand, without using a tool.

Figure 3:
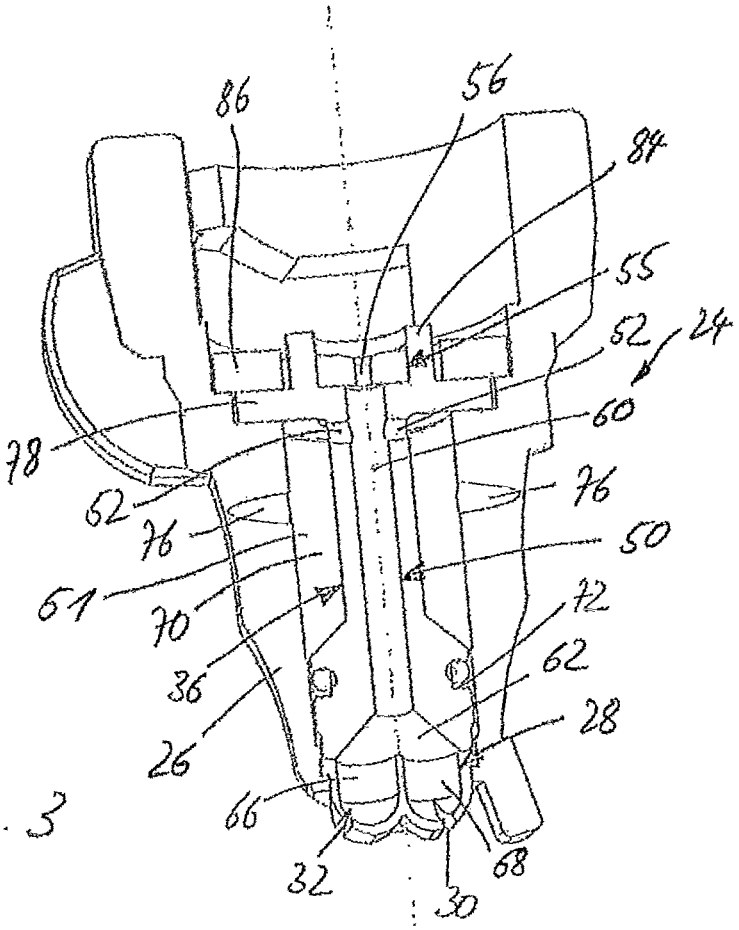
FIG. 3 shows a sectional illustration of the injector nozzle according to FIG. 1 in the assembled state.

In the illustration according to FIG. 2, the injector component 36 is not yet provided with a baffle 55, cf. FIG. 3, which then defines an inlet opening 56 for a fluid jet into the mixing chamber 50.

The illustration according to FIG. 3 shows a sectional view of the double flat spray nozzle 24 in the assembled state, wherein a sectional plane is approximately perpendicular to the sectional plane of FIG. 2. The mouthpiece 28 is installed in the housing.

During operation, a liquid jet enters into the circular cylindrical portion 60 of the mixing chamber 50 via the inlet openings 56 in the baffle 55. Therein, a diameter of the jet entering the mixing chamber 50 is significantly smaller than the diameter of the cylindrical portion 60 of the mixing chamber 50, since the diameter of the inlet opening 56 is also essentially smaller than the diameter of the cylindrical portion 60. As a result, a negative pressure is produced in the cylindrical portion 60, causing air to enter into the mixing chamber 50 from the annular gap space 70 via the air ventilation openings 52 and to admix with the liquid jet. A frustoconical enlargement 62 of the mixing chamber 50 adjoins the cylindrical portion 60. Then, the conical enlargement 62 passes into two outlet chambers 66 and 68. The outlet openings 30, 32 are cut in the outlet chambers 66 and 68. In the outlet chambers 66 and 68, there is a coarse drop distribution of liquid present, which liquid is then outputted via the outlet openings 30, 32, in each case in the form of a flat jet.

The annular gap space 70 provided between the injector component 36 and the housing 26 is vented via the air ventilation openings 76 from the environment. Environmental air is supplied to the intake openings 52 via said annular gap space 70.

The injector component 36 further has a housing portion with a circumferential groove 72, wherein an O-ring made of elastic material is placed. By means of the O-ring, the injector component 36 is held within the housing 26. The O-ring rests on the inner wall of the interior space 51, and the diameter of the injector component 36 above and below the groove 72 is slightly smaller than the diameter of the circular cylindrical interior space 51. During insertion of the injector component 36, said component is, thus, guided by means of the zones above and below the groove 72 in the interior space 51.

Figure 4:
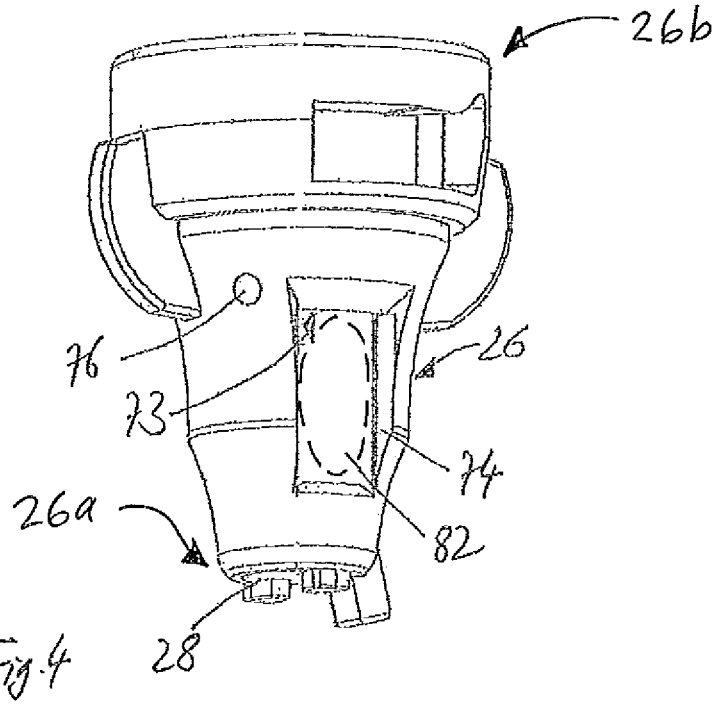
FIG. 4 shows an isometric illustration of a housing and a mouthpiece of the injector nozzle according to FIG. 1.

The illustration according to FIG. 4 shows the housing 26 with the mouthpiece 28 inserted therein. The housing 26 has the two rectangular through holes 74 located diametrically opposite one to the other, through which holes the outer wall 82 of the circular cylindrical interior space 51 is visible. Located between said outer wall 82 and the remainder of the housing 26 there is, cf. FIG. 2, a respective slot 73 through which then the operating pieces 54 of the injector component 36 are inserted. The location of said slots 73 ensures the correct orientation of the injector component 36 in the housing 26 at the same time. By reaching through the through holes 74, a user may grasp the handle portions 44 of the operating pieces 54 of the injector component 36 provided with corrugations, in order to push the injector component 36 completely into the housing 26 or to push it back out of the housing 26 again. The outer wall 82 is planar, the inner wall bordering the interior space 51 is circular and cylindrical in shape.

In FIG. 4, there is one of the air ventilation openings 76 visible in the housing 26, which are to connect the annular gap space 70 to the environment, cf. FIG. 3.

Figure 5:
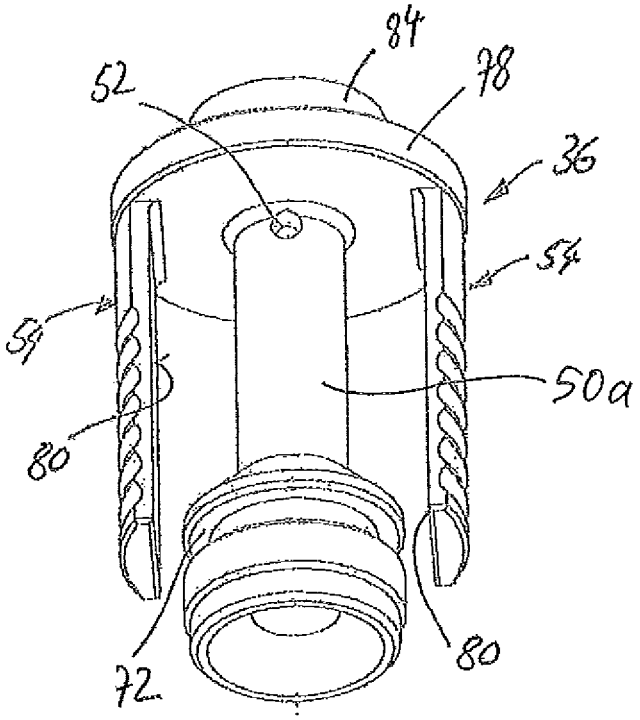
FIG. 5 shows an isometric illustration of an injector component adapted to be inserted into the housing according to FIG. 4.

The illustration of FIG. 5 shows the injector component 36. The two operating pieces 54 are connected to the mixing chamber portion of the injector component 36 by means of an annular flange 78. As a result, the operating pieces 54 are arranged at a distance to the mixing chamber portion. An inner surface 80 of the operating pieces 54 facing the mixing chamber portion is planar. Similarly, the portion 82 of the outer wall of the interior chamber 51, which portion is visible through the through holes 74, cf. FIG. 4, is planar. Thus, the inner surfaces 80 can smoothly slide on the planar portions 82 of the outer wall of the interior chamber 51 such that pushing in and pushing out of the injector component 36 without using a tool is readily possible.

The annular flange 78 is provided with a circumferential collar 84 on its upstream located side, which collar is a recess in circular cylindrical shape, cf. FIG. 2, wherein the baffle 55 can be inserted, cf. FIG. 3. In the completely assembled state of the injector component 36 a downstream located bottom side of the annular flange 78 is resting on an annular step of the housing 26, cf. FIG. 3, and thereby defines a completely inserted position of the injector component 36. On an upstream located upper side of the annular flange 78, there is an annular seal 86, which seal provides sealing of the housing 26, when the housing is placed on the nozzle support 22, cf. FIG. 1.

In FIG. 5 there is visible yet another of the air ventilation openings 52 leading into the mixing chamber 50. The groove 72 of the injector component 36 is shown without an O-ring in the illustration according to FIG. 5.

The invention claimed is:

1. A nozzle device comprising:

a housing component having a hollow interior and including a housing wall having an outer exterior surface, said housing wall defining therein a hole which opens outwardly through said outer exterior surface;

an intake compartment disposed interiorly of said housing component;

a first inlet disposed to receive a first substance;

a second inlet disposed to receive a second substance and to communicate same to said intake compartment;

a mixing chamber disposed to receive and mix together the first and second substances; and an injector component disposed within said interior of said housing component and including a handle portion disposed relative to said housing component such that said handle portion is exposed and accessible through said hole, said hole being separate from said second inlet so as not to communicate with said intake compartment interiorly of said housing component, and said hole being dimensioned to permit insertion of part of a human finger therein to allow manipulation of said handle portion through said hole and removal of said injector component from said housing component without use of a tool.

2. The nozzle device of claim 1, wherein said injector component includes a wall disposed in surrounding relation with said mixing chamber such that said mixing chamber is defined within said injector component.

3. The nozzle device of claim 2, further including an upstream portion which includes the first inlet and receives the first substance and a downstream portion spaced from said upstream portion adjacent which a mixture of the first and second substances exits said nozzle device from said mixing chamber, said housing wall including an inner wall surface disposed in opposed relation with an outer surface of said wall of said injector component, said inner surface being spaced from said outer surface so as to define said intake compartment between said inner and outer surfaces which receives the second substance therein from the second inlet, said handle portion being spaced outwardly from said outer surface of said wall of said injector component.

4. The nozzle device of claim 3, wherein said hole is a first hole and said housing component defines therein a second hole substantially identical to said first hole and disposed on an opposite side of said housing wall of said housing component from said first hole, said handle portion of said injector component is a first handle portion and said injector component includes a second handle portion substantially identical to said first handle portion and disposed on an opposite side of said injector component from said first handle portion, said second handle portion being disposed relative to said housing component such that said second handle portion is exposed and accessible through said second hole, said second hole being separate from said second inlet so as not to communicate with said intake compartment interiorly of said housing component, and said second hole being dimensioned to permit insertion of part of a human finger therein to allow manipulation of said second handle portion through said second hole and removal of said injector component from said housing component without use of a tool.

5. The nozzle device of claim 4, wherein said injector component includes a flange fixed to said wall thereof, said first and second handle portions having respective first ends fixed to said flange and respective second free ends which are spaced from the respective said first ends such that said first and second handle portions are cantilevered from said flange and are spaced outwardly from said wall of said injector component.

6. The nozzle device of claim 1, wherein said nozzle device defines a longitudinal axis and said hole has a longitudinally elongated rectangular or an oval shape extending substantially in the axial direction.

7. The nozzle device of claim 1, wherein said handle portion has a corrugated surface facing outwardly which is exposed and accessible through said hole to facilitate manipulation by a user.

8. The nozzle device of claim 1, further including an outlet through which a mixture of the first and second substances exits said nozzle device from said mixing chamber, said outlet being spaced downstream, with respect to a flow direction through said nozzle device, from said first and second inlets, said mixing chamber communicating with both said first and second inlets and said outlet and being defined within said injector component.

9. The nozzle device of claim 1, wherein said hole is a first hole and said housing component defines therein a second hole substantially identical to said first hole and disposed on an opposite side of said housing wall of said housing component from said first hole, said handle portion of said injector component is a first handle portion and said injector component includes a second handle portion substantially identical to said first handle portion and disposed on an opposite side of said injector component from said first handle portion, said second handle portion being disposed relative to said housing component such that said second handle portion is exposed and accessible through said second hole, said second hole being separate from said second inlet so as not to communicate with said intake compartment interiorly of said housing component, and said second hole being dimensioned to permit insertion of part of a human finger therein to allow manipulation of said second handle portion through said second hole and removal of said injector component from said housing component without use of a tool, said injector component having an end flange, said first and second handle portions having respective first ends fixed to said end flange and second free ends spaced from the respective said first ends such that said first and second handle portions are supported in a cantilevered manner from said end flange.

10. The nozzle device of claim 9, wherein said injector component includes a substantially tubular wall disposed in surrounding relation with and defining said mixing chamber, and said first and second handle portions are spaced outwardly from said wall of said injector component.

11. The nozzle device of claim 1, wherein said hole does not open inwardly into said intake compartment.

12. A nozzle device for discharging a mixture of first and second substances, said nozzle device comprising:

an outer housing component including a substantially tubular housing wall defining a hollow interior, said outer housing component having a first inlet configured to receive a first substance, a second inlet configured to receive a second substance different from the first substance, an outlet spaced downstream, with respect to a flow direction of substances through said nozzle device, from said first and second inlets, said housing wall defining therein a hole which opens outwardly through an outer surface of said housing wall and does not communicate with said second inlet interiorly of said outer housing component; and an inner injector component disposed within said interior of said outer housing component, said inner injector component defining therein a mixing chamber in communication with said first inlet such that said mixing chamber receives the first substance therein, said mixing chamber also being in communication with said second inlet such that said mixing chamber receives the second substance therein, said mixing chamber additionally communicating with said outlet such that a mixture of the first and second substances is discharged from said mixing chamber and through said outlet, said inner injector component including a mounting arm aligned relative to said outer housing component such that a portion of said arm is accessible through said hole, said hole being sized to permit insertion of part of a human finger therein to allow manipulation of said portion of said arm through said hole and ready removal of said inner injector component from said outer housing component.

13. The nozzle device of claim 12, wherein said inner injector component includes a substantially tubular wall disposed in surrounding relation with and defining said mixing chamber, and said housing wall includes an inner surface disposed in opposed and spaced relation with an outer surface of said wall of said injector component such that an intake chamber is defined between said inner and outer surfaces, said intake chamber receiving therein the second substance from said second inlet and communicating with said first inlet and said mixing chamber.

14. The nozzle device of claim 13, wherein said wall of said inner injector component defines therein an opening in communication with said mixing chamber and said intake chamber, and said housing wall defines therein said second inlet, said second inlet comprising an opening in communication with said intake chamber and opening through said outer surface of said housing wall to permit entry of the second substance into said nozzle device.

15. The nozzle device of claim 13, wherein said housing wall of said outer housing component includes a wall portion on which said inner surface is defined, said wall portion being disposed in surrounding relation with said wall of said inner injector component, said wall portion of said housing wall defining an outer surface facing away from said inner surface and being aligned with and defining part of said hole.

16. The nozzle device of claim 15, wherein said outer housing component defines a substantially central longitudinal axis and said housing wall has a slot communicating with said hole and opening in a direction substantially parallel with the axis and towards said first inlet, said mounting arm extending through said slot and having an inner surface disposed in opposed and facing relation with said outer surface of said wall portion.

17. The nozzle device of claim 12, further including an intake chamber disposed interiorly of said outer housing component and communicating with said second inlet, wherein said hole does not communicate with said intake chamber interiorly of said outer housing component.

18. A nozzle device for discharging a mixture of first and second substances, said nozzle device comprising:

a first inlet configured and disposed to receive a first substance;

a second inlet configured and disposed to receive a second substance;

an outlet spaced downstream, with respect to a flow direction of substances through said nozzle device, from said first and second inlets;

a mixing chamber in communication with said first inlet such that said mixing chamber receives the first substance therein, said mixing chamber also being in communication with said second inlet such that said mixing chamber receives the second substance therein, said mixing chamber additionally being in communication with said outlet such that a mixture of the first and second substances is discharged from said mixing chamber and through said outlet;

an outer housing component including an outer housing wall defining a hollow interior, said outer housing component defining therein a hole which opens outwardly through an outer exterior surface of said housing wall and does not fluidly communicate with said second inlet interiorly of said nozzle device; and an inner injector component disposed within said interior of said outer housing component and configured to inject the second substance into said mixing chamber, said inner injector component including a mounting arm having a manipulating portion aligned with said hole in said outer housing component such that said manipulating portion is accessible through said hole by a human finger inserted therein to allow manipulation of said manipulating portion through said hole and removal of said inner injector component from said outer housing component.

19. The nozzle device of claim 18, wherein said outer housing component and said inner injector component together define an intake compartment in communication with said second inlet to receive the second substance, said intake compartment being in communication with said mixing chamber and said mixing chamber being defined in said inner injector component.

20. The nozzle device of claim 18, further including an intake compartment located interiorly within said outer housing component and fluidly communicating with said second inlet, wherein said hole does not fluidly communicate with said intake compartment interiorly of said outer housing component.

* * * * *